US012622485B2

(12) United States Patent
Hurt

(10) Patent No.: US 12,622,485 B2
(45) Date of Patent: May 12, 2026

(54) DUAL PURPOSE RUNNING AND CYCLING SHOE

(71) Applicant: The Regents of the University of Colorado, Denver, CO (US)

(72) Inventor: James W. Hurt, Boulder, CO (US)

(73) Assignee: The Regents of the University of Colorado, Denver, CO (US)

( * ) Notice: Subject to any disclaimer, the term of this patent is extended or adjusted under 35 U.S.C. 154(b) by 158 days.

(21) Appl. No.: 18/022,315

(22) PCT Filed: Aug. 23, 2021

(86) PCT No.: PCT/US2021/047148

§ 371 (c)(1),
(2) Date: Feb. 21, 2023

(87) PCT Pub. No.: WO2022/040629

PCT Pub. Date: Feb. 24, 2022

(65) Prior Publication Data

US 2023/0320457 A1 Oct. 12, 2023

Related U.S. Application Data

(60) Provisional application No. 63/068,514, filed on Aug. 21, 2020.

(51) Int. Cl.

| | |
|---|---|
| ***A43B 13/12*** | (2006.01) |
| ***A43B 5/06*** | (2022.01) |
| ***A43B 5/14*** | (2006.01) |

(52) U.S. Cl.

CPC ..... *A43B 13/125* (2013.01); *A43B 5/06* (2013.01); *A43B 5/14* (2013.01)

(58) Field of Classification Search

CPC ..... A43B 5/06; A43B 5/14; A43B 13/125; A43B 13/184; A43B 13/24

See application file for complete search history.

(56) References Cited

U.S. PATENT DOCUMENTS 1,206,597 A * 11/1916 Russell ..... A43B 13/24 36/59 A
2,528,951 A * 11/1950 Epsztejn ..... A43B 13/36 36/15

(Continued)

FOREIGN PATENT DOCUMENTS

WO WO-9610346 A1 * 4/1996 ..... A43B 5/14
WO 2016063073 A1 4/2016

OTHER PUBLICATIONS

International Search Report and Written Opinion, dated Dec. 20, 2021, received in connection with International Patent Application No. PCT/US2021/047148, 13 pages.

*Primary Examiner* — Heather Mangine
*Assistant Examiner* — Raquel M. Weis
(74) *Attorney, Agent, or Firm* — Meunier Carlin & Curfman LLC

(57) ABSTRACT

A dual purpose running and cycling shoe. The shoe can include an upper portion, an outsole portion, and a midsole portion disposed between the upper portion and the outsole portion. The shoe can also include a rigid plate that is configured to selectively couple to a clipless cycling pedal. The rigid plate can be disposed between the upper portion and the outsole portion, and the rigid plate can extend along a horizontal axis at least partially from an end portion of a heel portion of the rigid plate towards an oppositely located end portion of a toe portion of the rigid plate.

16 Claims, 6 Drawing Sheets

(56) References Cited

U.S. PATENT DOCUMENTS 3,987,510 A * 10/1976 Sbicca ..... B29D 35/142 12/142 EV
4,294,025 A * 10/1981 Keller ..... A43B 5/0419 36/132
4,377,952 A * 3/1983 Gamondes ..... A43B 5/14 36/131
4,506,463 A * 3/1985 Chassaing ..... A43B 5/14 36/131
4,538,480 A * 9/1985 Trindle ..... B62M 3/086 36/131
4,640,151 A * 2/1987 Howell ..... B62M 3/086 36/131
4,712,314 A * 12/1987 Sigoloff ..... A43B 3/00 40/636
4,735,107 A * 4/1988 Winkie ..... B62M 3/086 36/131
4,803,894 A * 2/1989 Howell ..... B62M 3/086 36/131
4,825,565 A * 5/1989 Bigolin ..... A43B 5/14 36/131
4,876,808 A * 10/1989 Hsieh ..... A43B 5/14 36/129
4,893,420 A * 1/1990 Bezin ..... A43B 5/14 36/131
4,907,355 A * 3/1990 Allen ..... A43B 5/14 36/131
5,027,675 A * 7/1991 McCune ..... A43B 5/14 36/131
5,031,342 A * 7/1991 Crook ..... A43B 5/18 36/135
5,125,173 A * 6/1992 Nagano ..... B62M 3/086 36/131
5,205,056 A * 4/1993 Okajima ..... A43B 5/14 36/134
5,363,526 A * 11/1994 Okajima ..... A43B 5/14 12/133 B
5,406,723 A * 4/1995 Okajima ..... A43B 5/049 36/131
5,446,977 A * 9/1995 Nagano ..... A43B 5/14 36/31
5,685,093 A * 11/1997 Lin ..... A43B 1/0054 36/131
5,836,094 A * 11/1998 Figel ..... A43B 3/0073 36/131
5,845,421 A * 12/1998 Tanaka ..... A43B 5/0421 36/117.3
5,878,514 A * 3/1999 Ueda ..... B62M 3/086 36/131
6,189,242 B1 * 2/2001 Lin ..... A43B 5/14 36/131
6,260,291 B1 * 7/2001 Farys ..... A43B 5/14 36/108
6,477,793 B1 * 11/2002 Pruitt ..... A43B 5/14 36/144
7,516,562 B2 * 4/2009 Signori ..... A43B 13/36 36/131
7,533,480 B2 * 5/2009 Chao ..... A43B 5/14 36/131
7,536,810 B2 * 5/2009 Jau ..... A43B 5/14 36/131
9,254,016 B2 * 2/2016 Tews ..... A43B 5/185
10,517,349 B2 * 12/2019 Martin ..... B62M 3/086
10,660,399 B2 * 5/2020 Torrance ..... A43B 13/026
11,272,756 B2 * 3/2022 Torrance ..... A43B 13/188
11,291,266 B2 * 4/2022 Bird ..... A43B 13/12
11,638,460 B2 * 5/2023 Winefordner ..... A43B 5/14 36/131
2001/0022041 A1 * 9/2001 Gebhard ..... A43B 5/14 36/31
2003/0145677 A1 * 8/2003 Bremer ..... B62M 3/086 74/594.6
2005/0210712 A1 * 9/2005 Jau ..... A43B 5/14 36/131
2006/0016102 A1 * 1/2006 Xie ..... A43B 5/14 36/131
2006/0042119 A1 * 3/2006 Workman ..... A43B 5/08 36/15
2006/0080865 A1 * 4/2006 Chao ..... A43B 5/14 36/131
2006/0201035 A1 * 9/2006 Signori ..... A43B 5/14 36/131
2007/0017127 A1 * 1/2007 Chao ..... A43B 5/14 36/131
2008/0110294 A1 * 5/2008 Bryne ..... A43B 5/14 74/594.6
2009/0260477 A1 * 10/2009 Railing ..... A43B 5/14 74/594.6
2011/0138658 A1 * 6/2011 Ueda ..... A43B 5/14 36/131
2011/0302811 A1 * 12/2011 Chang ..... B62M 3/086 36/131
2012/0000095 A1 * 1/2012 Torrance ..... A43B 13/16 36/114
2012/0017471 A1 * 1/2012 Tews ..... A43B 5/185 36/131
2012/0227287 A1 * 9/2012 Czan ..... A43B 5/06 36/131
2013/0298428 A1 * 11/2013 Tews ..... A43B 3/246 36/134
2013/0340292 A1 * 12/2013 Cook ..... A43C 11/1493 36/131
2014/0259796 A1 * 9/2014 Hillyer ..... A43B 5/14 36/134
2016/0037857 A1 * 2/2016 Foxen ..... A43B 7/1485 36/103
2016/0157556 A1 * 6/2016 Barnes ..... A43B 13/36 36/31
2016/0309840 A1 * 10/2016 Lee ..... A43B 5/14
2016/0331067 A1 * 11/2016 McCaffrey ..... A43B 3/36
2017/0105472 A1 * 4/2017 Lee ..... A43B 13/026
2019/0142106 A1 * 5/2019 Winefordner ..... A43B 3/0078 36/103
2020/0016459 A1 * 1/2020 Smith ..... A43B 5/14
2022/0039510 A1 * 2/2022 Winefordner ..... A43B 13/14
2022/0322792 A1 * 10/2022 Kielbasa ..... A43C 15/04
2023/0320457 A1 * 10/2023 Hurt ..... A43B 13/125 36/25 R

* cited by examiner

DUAL PURPOSE RUNNING AND CYCLING SHOE

CROSS-REFERENCE TO RELATED APPLICATIONS

This application is a U.S. National Stage application filed under 35 U.S.C. § 371 of PCT/US2021/047148 filed Aug. 23, 2021, which claims the benefit of priority to U.S. Provisional Application 63/068,514 filed Aug. 21, 2020, each of which is hereby incorporated herein by reference in its entirety.

BACKGROUND

Traditionally, high performance cycling shoes are designed to be very stiff, and running shoes are designed to be more flexible. Even the stiffest of running shoes have not approached the stiffness of most high performance cycling shoes. Cycling shoes generally consist of an upper and a rigid plate. The rigid plate includes a cleat that snaps into place on a cycling pedal. Cycling shoes are generally engineered to be as stiff as possible in order to provide a high mechanical output and allow the cyclist to achieve maximum velocity while sprinting, for instance. However, recent research has shown that many existing cycling shoes are built far stiffer than necessary for maximal performance. Additionally, running shoes with stiffer components have become more prevalent.

High performance running shoes generally include an upper, a midsole, and an outsole. There are various running shoes with rigid plates made of carbon fiber or nylon, for instance, worn by professional runners. The rigid plate assists in propulsion, energy return, and distributing the force of the runner's foot into the cushioning midsole each time the runner's foot hits the ground. As a result of the inclusion of a rigid plate, many current high-performance running shoes are stiffer than those in the past.

It is with respect to these and other considerations that the various aspects of the present disclosure are described herein.

SUMMARY

In some aspects, the present disclosure relates to a dual purpose running and cycling shoe. In some aspects, shoes according to various embodiments of the present disclosure combine aspects of a high-performance cycling shoe and running shoe.

According to one aspect of the present disclosure, and in accordance with some embodiments, a shoe includes: an upper portion; an outsole portion; a midsole portion disposed between the upper portion and the outsole portion; and a rigid plate configured to selectively couple to a clipless cycling pedal. The rigid plate is disposed between the upper portion and the outsole portion. The rigid plate extends along a horizontal axis at least partially from an end portion of a heel portion of the rigid plate towards an oppositely located end portion of a toe portion of the rigid plate.

In some embodiments, the midsole portion can comprise a first cushioned midsole and a second cushioned midsole. The rigid plate can be disposed between the first cushioned midsole and second cushioned midsole.

In some embodiments, the rigid plate can extend along the horizontal axis from a heel portion of the shoe to an oppositely located toe portion of the shoe.

In some embodiments, the rigid plate can extend along a horizontal axis from an end of the heel portion of the shoe to an end of the oppositely located toe portion of the shoe.

In some embodiments, the shoe further comprises at least one attachment component that is configured to couple to a clipless pedal cleat.

In some embodiments, the rigid plate extends at least from a location corresponding to the heel portion of the shoe to at least a location corresponding to the clipless pedal cleat.

In some embodiments the shoe also comprises a selectively attachable and detachable clipless pedal cleat.

In some embodiments the rigid plate comprises one or more fastening members to removably couple a clipless pedal cleat to the rigid plate. In some embodiments, at least part of the outsole portion is configured to define a recess to receive the clipless pedal cleat.

In some embodiments, at least part of the midsole portion, along with the at least part of the recess defined in the outsole portion, further defines a recess to receive the clipless pedal cleat.

In some embodiments, the shoe also comprises at least one selectively attachable and detachable plug configured to replace a clipless pedal cleat when a clipless pedal cleat is not selectively attached.

In some embodiments, at least part of a rigid plate is configured to define at least one aperture or hole such that the at least one aperture or hole is configured to receive at least part of a pedal cleat and/or at least part of a clipless pedal to selectively couple the rigid plate to the clipless pedal.

In some embodiments, at least part of a midsole portion is constructed with a cushioned material.

In some embodiments, at least part of an outsole portion is constructed with a flexible material.

According to another aspect of the present disclosure, and in accordance with some embodiments, a shoe comprises: an upper portion; an outsole portion; a cushioned midsole portion directly disposed between the upper portion and the outsole portion; and a rigid plate configured to selectively couple to a clipless cycling pedal.

In some embodiments, a rigid plate extends along a horizontal axis from a heel portion of the shoe to an oppositely located toe portion of the shoe.

In some embodiments, a rigid plate extends from an end of the heel portion of the shoe to an end of the oppositely located toe portion of the shoe.

In some embodiments, at least part of a rigid plate is configured to define at least one aperture or hole, such that the at least one aperture or hole is configured to receive at least part of a selectively removable cleat and/or at least part of a clipless pedal to selectively couple the rigid plate to a clipless pedal.

In some embodiments, a rigid plate includes a magnetic portion.

In some embodiments, a magnetic portion of a rigid plate is configured to selectively and magnetically couple to a clipless cycling pedal.

In some embodiments, a rigid plate includes an integrated permanent cleat configured to selectively couple to a clipless cycling pedal.

In some embodiments, a rigid plate includes an integrated extruded portion configured to couple to a clipless cycling pedal.

In some embodiments, an integrated extruded portion of a rigid plate extends upwardly along a vertical axis.

In some embodiments, an integrated extruded portion of a rigid plate extends downwardly along a vertical axis.

In some embodiments, a rigid plate defines at least one hole configured to selectively couple to a clipless cycling pedal.

According to another aspect of the present disclosure, and in accordance with some embodiments, a shoe comprises: an upper portion; a rigid plate; a midsole portion; and an outsole portion, A least part of the outsole portion and at least part of the midsole portion are configured to each define a respective recess configured to receive a clipless cycling pedal cleat to couple the clipless pedal cleat to the rigid plate.

In some embodiments, a rigid plate extends along a horizontal axis from a heel portion of the shoe to an oppositely located toe portion of the shoe.

In some embodiments, a rigid plate extends along a horizontal axis from an end of a heel portion of the shoe to an end of the oppositely located toe portion of the shoe.

In some embodiments, a rigid plate is disposed directly between an upper portion and a midsole portion.

Other aspects and features according to the example embodiments of the present disclosure will become apparent to those of ordinary skill in the art, upon reviewing the following detailed description in conjunction with the accompanying figures.

BRIEF DESCRIPTION OF THE DRAWINGS

The accompanying figures, which are not necessarily drawn to scale, and which are incorporated in and constitute a part of this specification, illustrate several aspects described below.

DETAILED DESCRIPTION

Figure 1B:
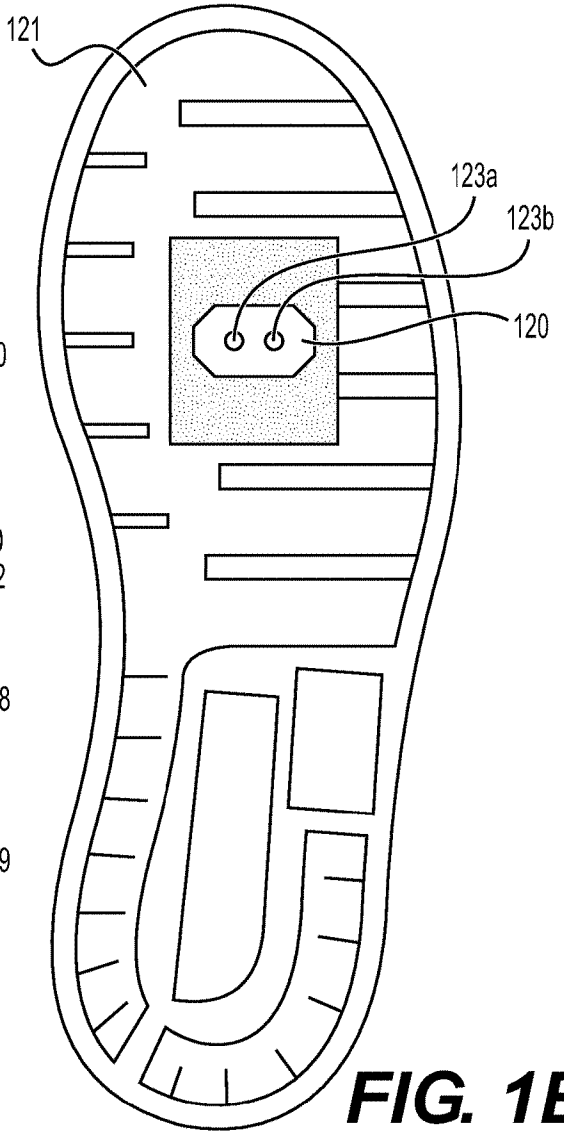
FIGS. 1A-1D illustrate various embodiments of a mid-loaded shoe according to the present disclosure.

In some aspects, the present disclosure relates to dual purpose shoes usable for both running and cycling. Although example embodiments of the present disclosure are explained in detail herein, it is to be understood that other embodiments are contemplated. Accordingly, it is not intended that the present disclosure be limited in its scope to the details of construction and arrangement of components set forth in the following description or illustrated in the drawings. The present disclosure is capable of other embodiments and of being practiced or carried out in various ways.

It must also be noted that, as used in the specification and the appended claims, the singular forms "a," "an" and "the" include plural referents unless the context clearly dictates otherwise.

By "comprising" or "containing" or "including" is meant that at least the named compound, element, particle, or method step is present in the composition or article or method, but does not exclude the presence of other compounds, materials, particles, method steps, even if the other such compounds, material, particles, method steps have the same function as what is named.

In describing example embodiments, terminology will be resorted to for the sake of clarity. It is intended that each term contemplates its broadest meaning as understood by those skilled in the art and includes all technical equivalents that operate in a similar manner to accomplish a similar purpose. It is also to be understood that the mention of one or more components in a device or system does not preclude the presence of additional components or intervening components between those components expressly identified.

A detailed description of certain example embodiments of the present disclosure will now be provided with reference to the accompanying drawings. The drawings form a part hereof and show, by way of illustration, specific embodiments and examples. In referring to the drawings, like numerals represent like elements throughout the several figures. It should be recognized that certain elements or orientations may be referred to herein with respect to a vertical axis or a horizontal axis (see, e.g., vertical axis A and horizontal axis B in FIG. A). Accordingly, directional or orientation of various components may be referred to as, for instance, "upwards", "downwards", "above", and/or "below" (among other spatial terms) are generally with respect to a vertical axis A. Similarly, directional or orientation terminology of various components may be referred with respect to for instance, "left", "right", "left-most", and/or "right-most". Accordingly, these horizontal directional/orientational terminology are generally with respect to a horizontal axis B.

Figure 1A:
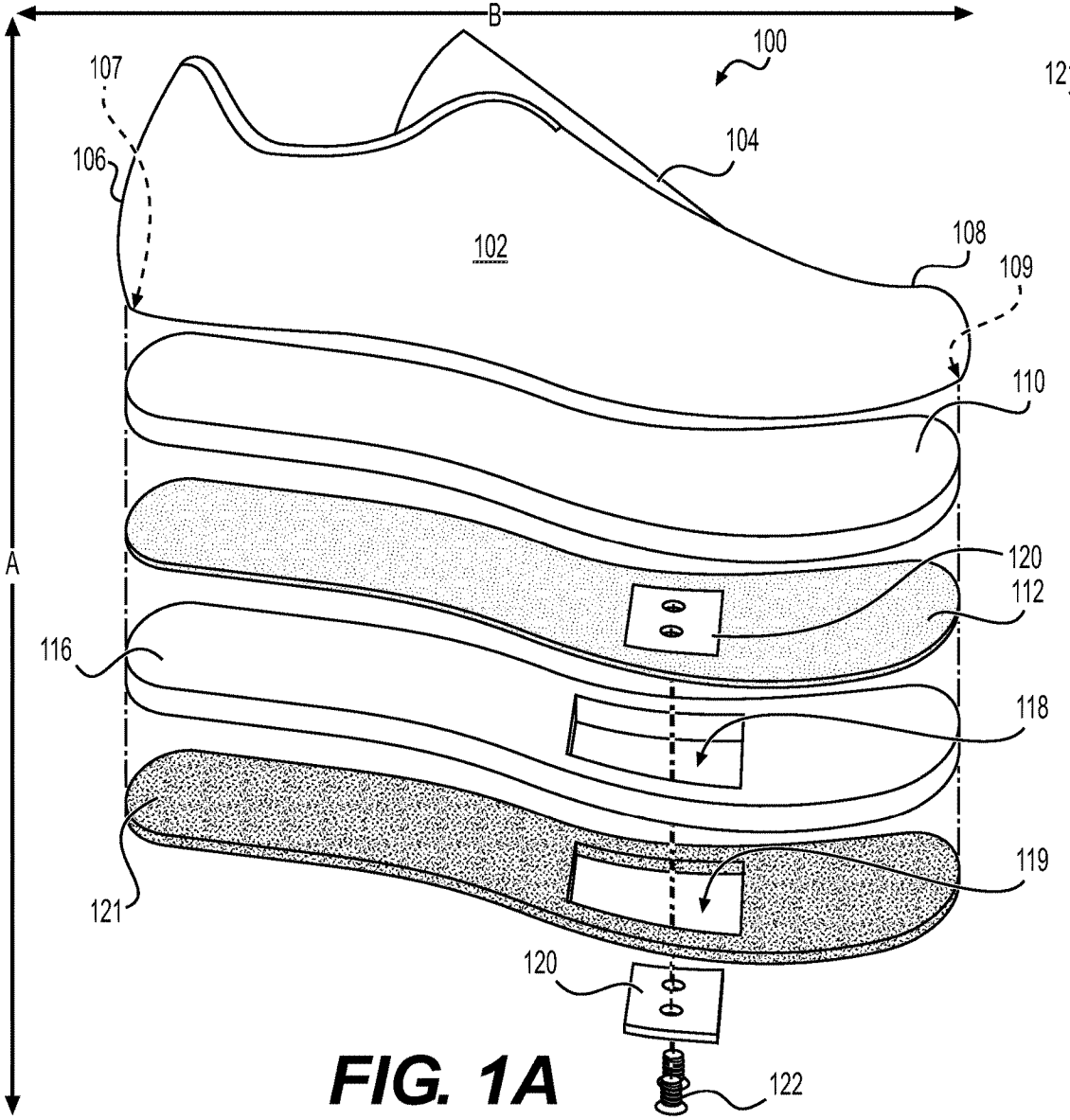

FIGS. 1A-1D illustrate various embodiments of a mid-loaded shoe 100 according to the present disclosure. FIG. 1A shows an exploded side isometric view of a mid-loaded shoe 100, illustrating an upper portion 102 of the shoe with a heel portion 106 and an oppositely disposed front toe portion 108. The tongue and lacing section 104 (i.e., a standard shoe-lace section) is shown at the top of the upper portion 102 of the shoe. In the exploded view of FIG. 1A, the next layer of the shoe (i.e., below the upper portion 102) is a first cushioned midsole portion 110. A second cushioned midsole portion 116 is also included; the first cushioned midsole portion 110 is disposed above a rigid plate 112 running from the heel portion 106 of the shoe to the front portion 108 of the shoe, and a second cushioned midsole portion 112 is disposed below the rigid plate 112. In the embodiment of FIG. 1, the rigid plate 112 extends along a horizontal axis all the way from the back-most end 107 of the heel portion 106 to the front-most end 109 of the toe portion 108. Accordingly, this configuration of the rigid plate 112 may be referred to herein in some instances as a full-length plate.

As shown, the second cushioned midsole portion 116 has a portion thereof that defines a hole therethrough, although there are still portions of the second midsole portion 116 that surround the defined hole. The outsole portion 121 of the shoe also has a portion thereof that defines a hole 119 therethrough, and the hole 119 defined in the outsole portion 121 is aligned with the hole 118 defined in the second midsole portion 116, such that a cycling pedal cleat 120 can be coupled to the rigid plate 112 through the defined holes 118, 119. The cleat 120 has two bores 123*a*, 123*b* (i.e., holes extending throughout the top to bottom of the cleat), and the cleat 120 can be secured to the rigid plate 112 through the use of fasteners 122 such as screws, pins, or bolts. The outsole portion 121 (see sections 121*a* and 121*b*) is constructed with select materials and configured such that is has advantageous properties in terms of traction and durability.

Figure 1C:
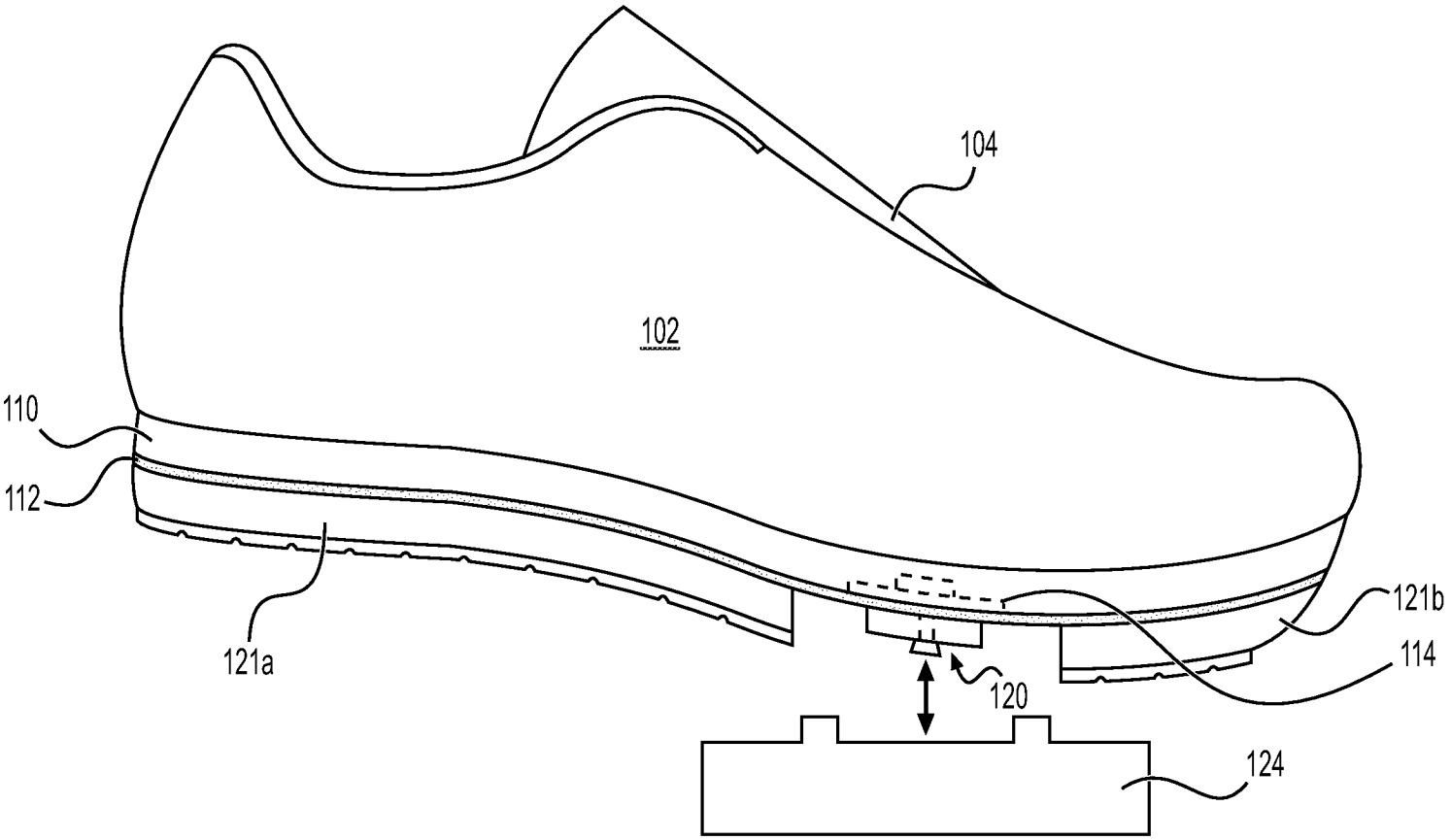

In the embodiment shown in FIG. 1A, it should be noted that the rigid plate 112 should be recessed upwards in the shoe enough for a standard clipless cycling pedal cleat (e.g., cleat 120) to be positioned such that when a user (i.e., human wearer of the shoe) is using the shoe 100 to run and the outsole portion 121 is compressed from impact, the pedal cleat 120 should not strike the ground (see also cleat configuration in FIG. 1C). Further specifics of the design of the outsole portion 121 and the pedal cleat 120 according to one embodiment of the mid-loaded shoe are shown in the view of FIG. 1B.

FIG. 1C is a partial, side view illustrating an embodiment of the mid-loaded shoe, where each of the components are attached as a functioning running shoe (i.e., this is not an exploded view, but rather shows a running shoe assembled and ready for use by a user). FIG. 1C particularly shows an assembled cycling pedal cleat 120 coupled to the rigid plate 112. FIG. 1C also shoes a standard type clipless cycling pedal 124.

Figure 1D:
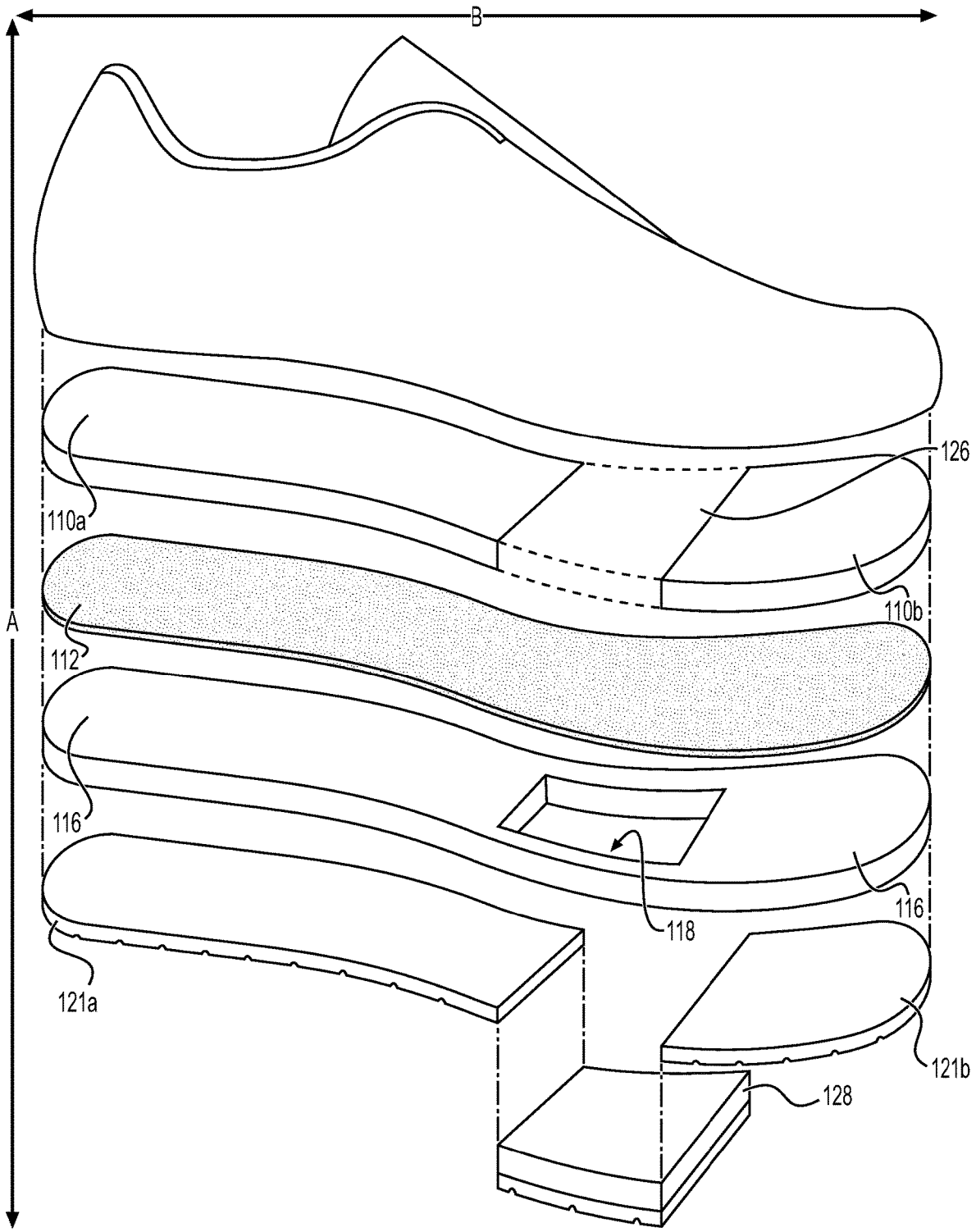

FIG. 1D is a partial side view illustrating an embodiment of the mid-loaded running shoe in which selectively detachable and selectively attachable plugs 126 and 128 may be inserted to fill voids that may, in a cycling mode, include a cleat. The selectively attachable and detachable plugs 126 and 128 can be used when the user is in running mode and, as an example, may want to disassemble or otherwise detach the cleat (see, e.g., cleat 120) from the rigid plate 112 and replace these areas with more cushioned portions in the form of the selectively attachable and detachable plugs 126, 128. The plugs 126, 128 can be formed and dimensioned such that they completely fit between the laterally separated sections 110*a*, 110*b* of the first midsole portion 110 and/or fit between the laterally separated sections 121*a*, 121*b* of the outsole portion 121.

Figure 2A:
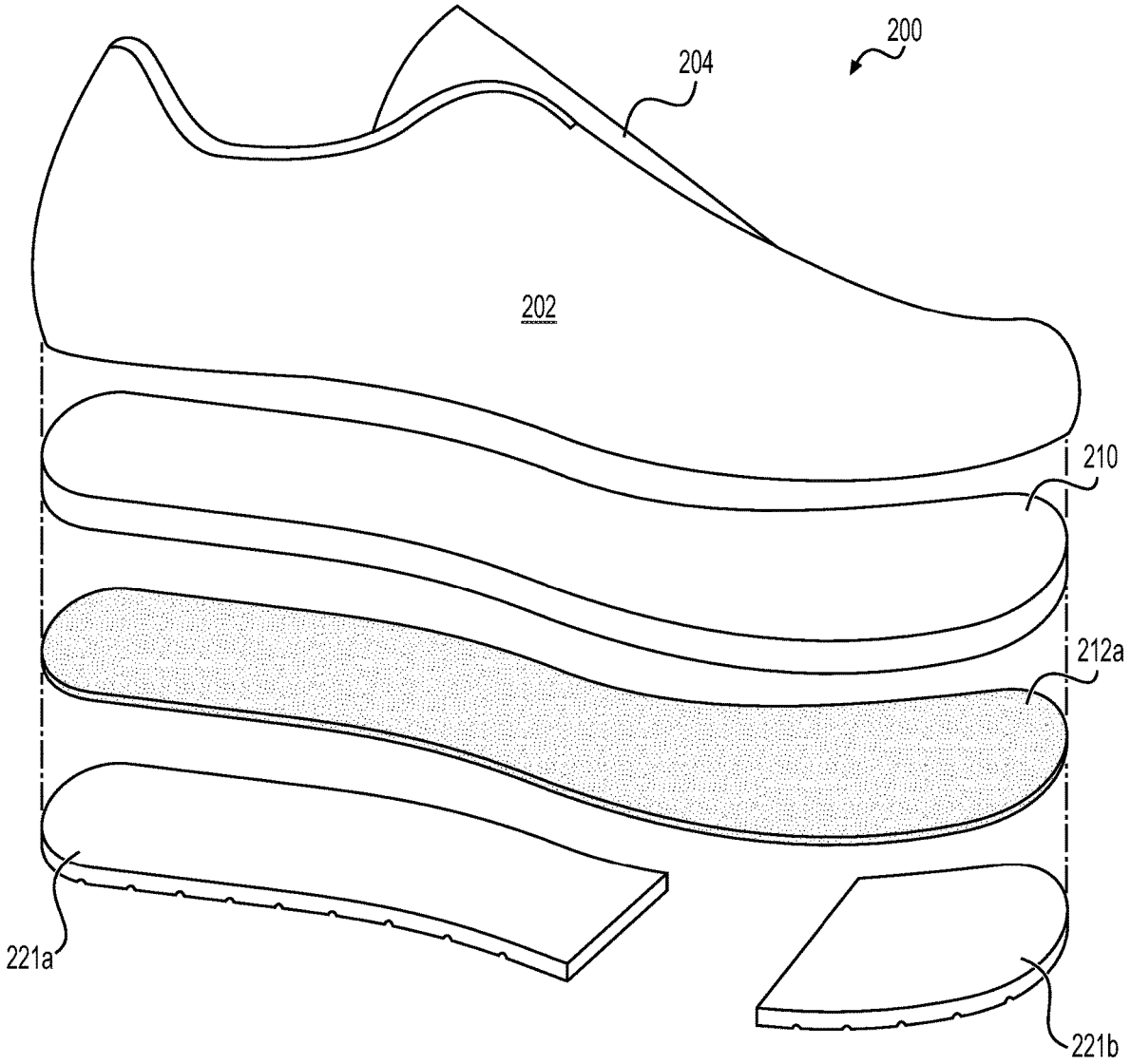
FIGS. 2A, 2B, and 2C illustrate various embodiments of a bottom-loaded shoe according to the present disclosure.
Figure 2C:
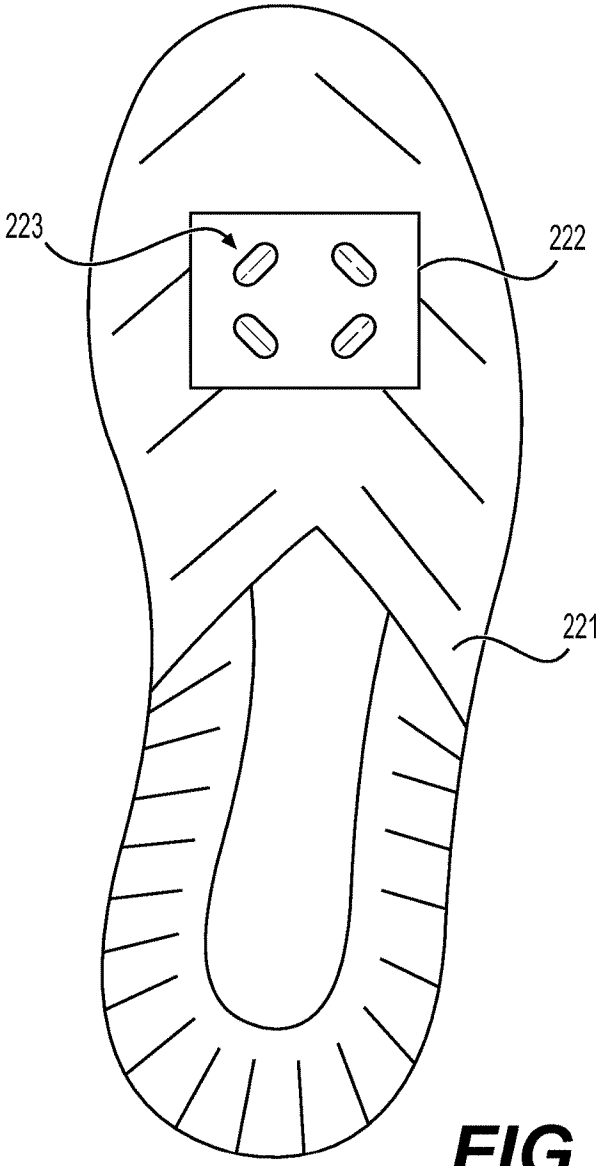
Figure 2B:
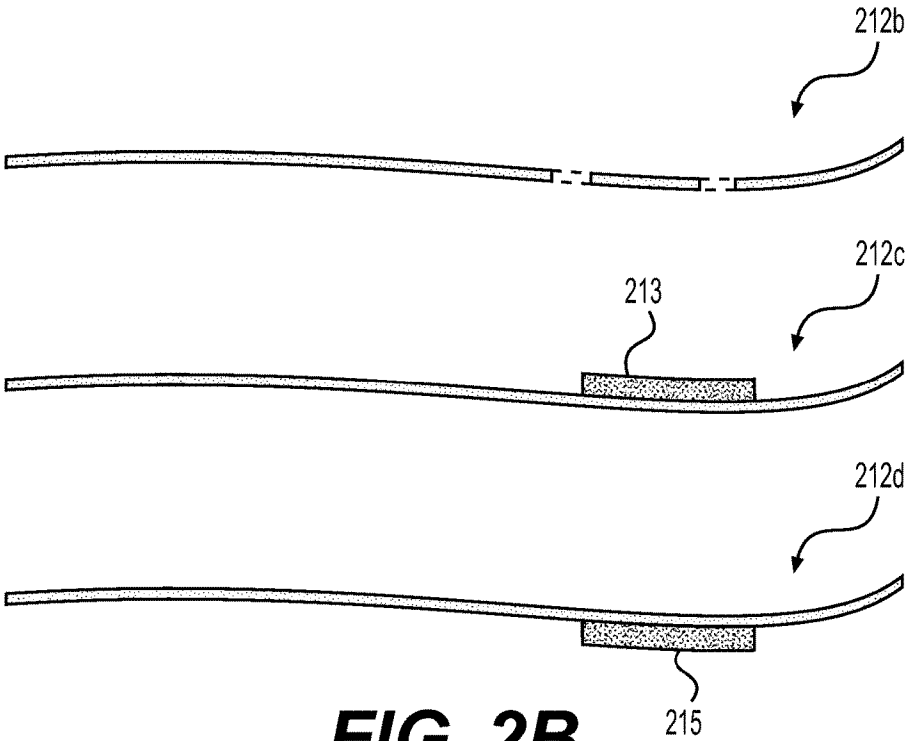

FIGS. 2A, 2B, and 2C illustrate various embodiments of a bottom-loaded shoe 200 according to the present disclosure. FIG. 2A shows a partial side exploded view of a bottom-loaded shoe 200. As shown in FIG. 2A, the bottom-loaded shoe includes an upper portion 202 with laces 204, a cushioned midsole portion 210 below the upper portion 202, and a rigid full length plate 212 (see discussion of rigid full length plate above with respect to embodiments of FIGS. 1A-1D) below the cushioned midsole portion 210. The outsole portion 221 is segmented laterally, with portions 221*a* and 221*b*.

In the bottom-loaded shoe 200, the rigid plate 212 (shown in FIG. 2A as a design 212*a*) can be configured according to various designs (see, e.g. alternative designs 212*b*, 212*c*, 212*d*), in order to serve as a cleat, rather than having a removable separate cycling pedal cleat. For example, as shown in the alternative design of the rigid plate 212*b*, the rigid plate 212*b* is segmented with holes in the rigid plate 212*b* (see, for example bottom view FIG. 2C of bottom-loaded shoe that has a plate that defines holes 223 for receiving respective portions of a clipless cycling pedal). As another embodiment of the rigid plate, design 212*c* has an upward-extending protrusion section 213 that is integral with the rigid plate 212*c*. As another embodiment of the rigid plate, design 212*d* has a downward-extending protrusion section 215 that is integral with the rigid plate 212*d*.

It should be noted that in the bottom-loaded shoe 200, the shoe does not include a cleat, since the rigid plate embodiments can function as a cleat. In the various designs of the rigid plate, the design 212*b* is configured with the upward-extending integral protrusion in order to effectively position the rigid plate closer to a cycling pedal. The design 212*c* is configured with the downward-extending integral protrusion in order to effectively position the rigid plate closer to the bottom of the shoe (i.e., closer to the outsole portion 221).

Figure 3:
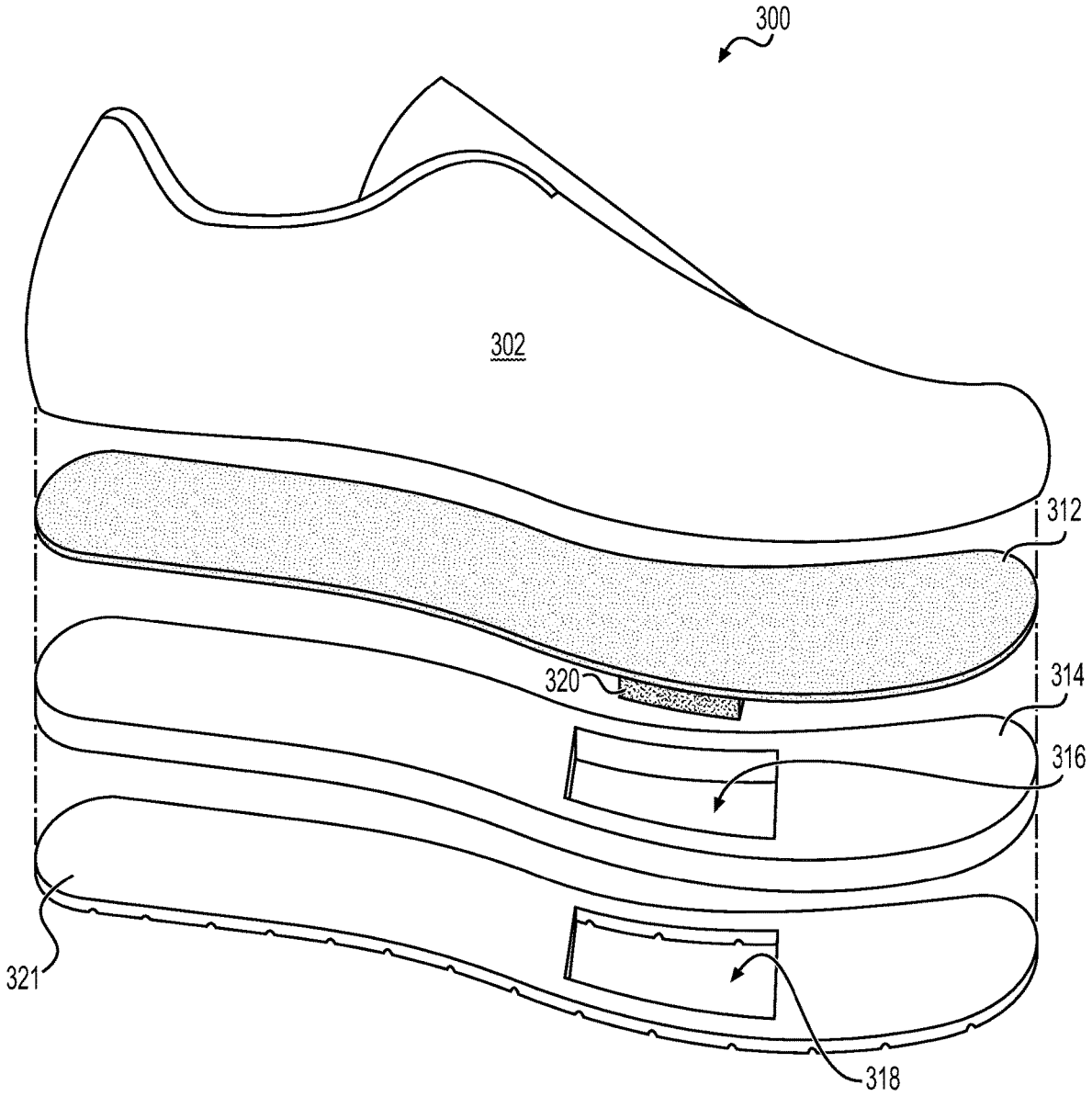
FIG. 3 illustrates a partial side exploded view of a top-loaded shoe according to the present disclosure.

FIG. 3 illustrates a partial side exploded view of a top-loaded shoe 300. The top-loaded shoe has an upper portion 302, a full-length rigid plate 312 below the upper portion 302, a cushioned midsole portion 314 below the rigid plate 312, and an outsole portion 321 below the cushioned midsole portion 314.

As shown, the cushioned midsole portion 314 has a portion thereof that defines a hole 316 therethrough, although there are still portions of the midsole portion 314 that surround the defined hole. The outsole portion 321 of the shoe also has a portion thereof that defines a hole 318 therethrough, and the hole 318 is aligned with the hole 316 defined in the midsole portion 314, such that a cycling pedal cleat (see, e.g., cleat 320) can be received through the defined holes 316, 318 and coupled to the rigid plate 312. In the top-loaded shoe 300, the cushioning is concentrated in the portions that are below the rigid plate 312. This design can be advantageous in that it can offer a user the ability to use a wide variety of cleats. Alternatively, the rigid plate 312 can function as the cleat.

The various embodiments described above are provided by way of illustration only and should not be construed to limit the scope of the present disclosure. Certain patentable aspects of various embodiments of the present disclosure are presented in the appended claims. Those skilled in the art will readily recognize that various modifications and changes may be made to the present disclosure without following the example embodiments and implementations illustrated and described herein, and without departing from the spirit and scope of the disclosure and claims here appended and those which may be filed in non-provisional patent application(s). Therefore, other modifications or embodiments as may be suggested by the teachings herein are particularly reserved.

What is claimed is:

1. A shoe, comprising:

an upper portion;

an outsole portion defining at least a portion of a recess;

a midsole portion disposed between the upper portion and the outsole portion, the midsole portion defining at least a portion of the recess;

a rigid plate configured to selectively couple to a clipless cycling pedal, wherein the rigid plate is disposed between the upper portion and the outsole portion, wherein the rigid plate extends along a horizontal axis at least partially from a heel portion of the rigid plate towards an oppositely located toe portion of the rigid plate;

a selectively attachable and detachable clipless pedal cleat, wherein the rigid plate includes one or more fasteners to couple the clipless pedal cleat to the rigid plate in a cycling mode of the shoe, wherein the clipless pedal cleat is disposed within the recess and spaced apart from a bottom surface of the outsole portion; and at least one selectively attachable and detachable plug configured to fill the recess in a running mode of the shoe, the plug comprising a midsole plug portion and an outsole plug portion, the plug being formed and dimensioned to fit completely within the portion of the recess defined by the midsole portion and the portion of the recess defined by the outsole portion.

2. The shoe of claim 1, wherein the midsole portion comprises a first cushioned midsole and a second cushioned midsole, and wherein the rigid plate is disposed between the first cushioned midsole and the second cushioned midsole.

3. The shoe of claim 1, wherein the rigid plate is a full length rigid plate that extends along the horizontal axis from an end of the heel portion of the shoe to an end of the oppositely located toe portion of the shoe.

4. The shoe of claim 1, wherein the outsole portion comprises a first section and a second section laterally separated from the first section by the recess, wherein the midsole portion comprises a first section and a second section laterally separated from the first section by the recess, wherein the plug is formed and dimensioned to completely fit between first and second sections of each of the outsole portion and the midsole portion.

5. The shoe of claim 1, wherein the rigid plate extends at least from a location corresponding to the heel portion of the shoe to at least a location corresponding to the clipless pedal cleat.

6. The shoe of claim 1, wherein at least part of the rigid plate is configured to define at least one aperture or hole such that the at least one aperture or hole is configured to receive at least part of a pedal cleat and/or at least part of a clipless pedal to selectively couple the rigid plate to the clipless pedal.

7. The shoe of claim 1, wherein at least part of the midsole portion is constructed with a cushioned material and wherein at least part of the outsole portion is constructed with a flexible material.

8. A shoe, comprising:

an upper portion;

an outsole portion defining a hole;

a cushioned midsole portion disposed between the upper portion and the outsole portion; and a rigid plate disposed above the outsole portion, the rigid plate comprising an integrated cleat on a surface of the rigid plate, wherein the rigid plate is a full length plate extending along a horizontal axis from an end of a heel portion of the shoe to an end of an oppositely located toe portion of the shoe, wherein the cleat extends at least partially through the hole of the outsole portion and is configured to selectively couple to a clipless cycling pedal, wherein the rigid plate further includes a magnetic portion configured to selectively and magnetically couple to a clipless cycling pedal.

9. The shoe of claim 8, wherein the cleat of the rigid plate defines at least one aperture or hole such that the at least one aperture or hole is configured to receive at least part of a clipless pedal to selectively couple the rigid plate to the clipless pedal.

10. The shoe of claim 8, wherein the rigid plate is further disposed above the midsole portion, wherein the midsole portion defines a recess aligned with the hole of the outsole portion, wherein the cleat extends at least partially through the recess.

11. The shoe of claim 10, further comprising at least one selectively attachable and detachable plug configured to fill the hole and the recess, the at least one selectively attachable and detachable plug comprising a midsole plug portion and an outsole plug portion.

12. The shoe of claim 8, wherein the midsole portion comprises a first cushioned midsole and a second cushioned midsole, and wherein the rigid plate is disposed between the first cushioned midsole and the second cushioned midsole.

13. The shoe of claim 8, wherein the rigid plate further comprises a downward-extending protrusion integrally formed with the rigid plate, the downward-extending protrusion forming the cleat.

14. The shoe of claim 8, wherein the rigid plate further comprises an upward-extending protrusion integrally formed with the rigid plate, the upward-extending protrusion forming the cleat.

15. The shoe of claim 8, wherein at least a portion of the cleat is disposed within the hole and spaced apart from a bottom surface of the outsole portion.

16. The shoe of claim 8, further comprising at least one selectively attachable and detachable plug configured to fill the hole.

* * * * *